US010392900B2

(12) United States Patent
Rytlewski et al.

(10) Patent No.: US 10,392,900 B2
(45) Date of Patent: Aug. 27, 2019

(54) ACTUATION CONTROL SYSTEM USING PILOT CONTROL CIRCUIT

(71) Applicant: Schlumberger Technology Corporation, Sugar Land, TX (US)

(72) Inventors: Gary Rytlewski, League City, TX (US); Colin Arthur Longfield, Clamart (FR); James G. Filas, Missouri City, TX (US); Edgar Montiel, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 258 days.

(21) Appl. No.: 15/317,271

(22) PCT Filed: Jun. 29, 2015

(86) PCT No.: PCT/US2015/038274

§ 371 (c)(1),
(2) Date: Dec. 8, 2016

(87) PCT Pub. No.: WO2016/003881

PCT Pub. Date: Jan. 7, 2016

(65) Prior Publication Data

US 2017/0122069 A1 May 4, 2017

Related U.S. Application Data

(60) Provisional application No. 62/019,033, filed on Jun. 30, 2014.

(51) Int. Cl.
*E21B 34/10* (2006.01)
*E21B 49/08* (2006.01)

(52) U.S. Cl.
CPC ..... *E21B 34/10* (2013.01); *E21B 49/087* (2013.01)

(58) Field of Classification Search
CPC ..... E21B 34/10; E21B 34/06; E21B 34/16; E21B 49/087; E21B 23/04; E21B 4/14;
(Continued)

(56) References Cited

U.S. PATENT DOCUMENTS 4,422,506 A * 12/1983 Beck ..... E21B 34/108 166/264
5,050,681 A * 9/1991 Skinner ..... E21B 34/066 166/319

(Continued)

OTHER PUBLICATIONS

PCT/US2015/038274 International Search Report and Written Opinion, dated Sep. 21, 2015, 8 pgs.

(Continued)

*Primary Examiner* — George S Gray
(74) *Attorney, Agent, or Firm* — Cameron R. Sneddon

(57) ABSTRACT

A technique facilitates mechanical operation of components, e.g. valves, without utilizing electronics at the components or control lines routed to the components. An actuation control system is fully mechanical in the sense that it is constructed to mechanically shift to different control positions via pressure input, such as pressure input supplied along a wellbore annulus. The actuation control system utilizes a spool valve coupled with a pilot control circuit which establishes a reference pressure that can be used in shifting the spool valve to different operational positions.

17 Claims, 3 Drawing Sheets

(58) Field of Classification Search
CPC .. E21B 47/08; E21B 44/00; F01L 9/02; F01L 9/04; F16K 31/00–31/62; F16K 11/07–11/0716; F16K 31/12–31/1245
USPC ..... 137/488, 489, 489.5; 251/25, 28, 62
See application file for complete search history.

(56) References Cited

U.S. PATENT DOCUMENTS

| | | | | |
|---|---|---|---|---|
| 6,176,324 | B1 | 1/2001 | Cadet | |
| 7,478,555 | B2 | 1/2009 | Zhan et al. | |
| 7,743,833 | B2 | 6/2010 | Cascario et al. | |
| 2008/0066701 | A1 | 3/2008 | Sun | |
| 2010/0175868 | A1 | 7/2010 | Wright et al. | |
| 2016/0177686 | A1* | 6/2016 | Carvajal ..... | E21B 43/12 700/282 |

OTHER PUBLICATIONS

International Preliminary Report on Patentability issued in the related PCT application PCT/US2015/038274, dated Jan. 3, 2017 (5 pages).

* cited by examiner

ACTUATION CONTROL SYSTEM USING PILOT CONTROL CIRCUIT

CROSS-REFERENCE TO RELATED APPLICATIONS

The present document is based on and claims priority to U.S. Provisional Application Ser. No. 62/019,033, filed Jun. 30, 2014, which is incorporated herein by reference in its entirety.

BACKGROUND

Hydrocarbon fluids such as oil and natural gas are obtained from a subterranean geologic formation, referred to as a reservoir, by drilling a wellbore that penetrates the hydrocarbon-bearing formation. Once a wellbore is drilled, various forms of well completion components may be installed to control and enhance efficiency of producing fluids from the reservoir. In various applications, valves are selectively actuated to control fluid flows along the well completion components. The valves may be controlled via control lines routed downhole and/or via electronics which receive control signals, e.g. electrical control signals or pressure pulses. In some applications, the downhole location or environment may be problematic for electronics or control lines.

SUMMARY

In general, a methodology and system are provided which facilitate mechanical operation of components, e.g. valves, without utilizing electronics at the components or control lines routed to the components. An actuation control system is fully mechanical in the sense that it is constructed to mechanically shift to different control positions via pressure input, such as pressure input supplied along a wellbore annulus. The actuation control system utilizes a spool valve coupled with a pilot control circuit which establishes a reference pressure that can be used to shift the spool valve to different operational positions.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
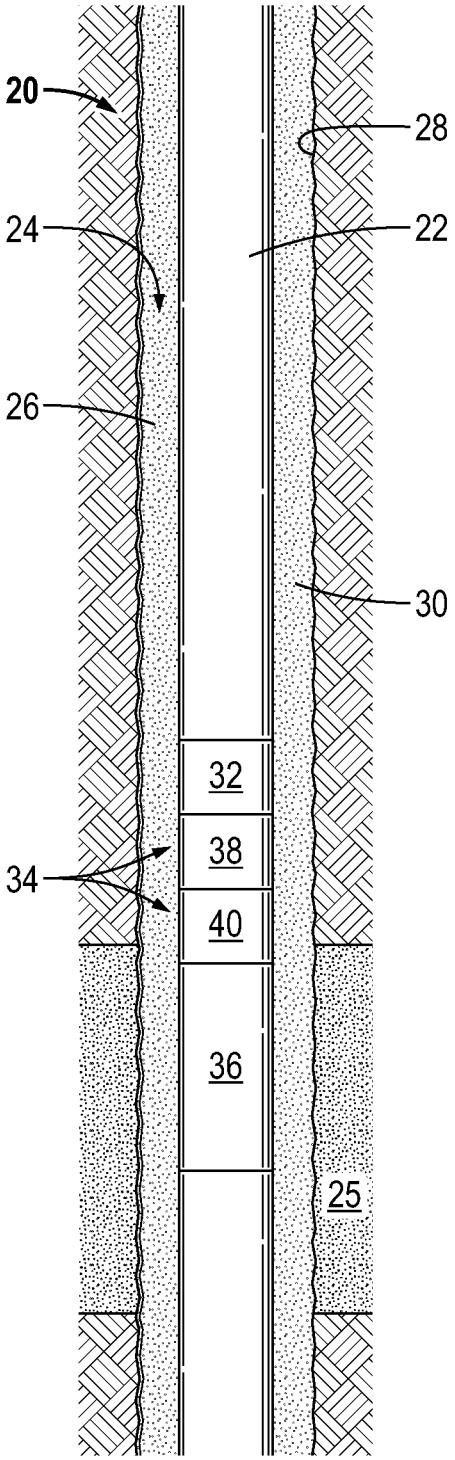
FIG. 1 is a schematic illustration of an example of a well system utilizing an actuation control system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a methodology and system which facilitate mechanical operation of components, e.g. valves, without utilizing electronics at the components or control lines routed to the components. An actuation control system is fully mechanical in the sense that it is constructed to mechanically shift to different control positions via pressure input, such as pressure input supplied along a wellbore annulus. The actuation control system utilizes a spool valve coupled with a pilot control circuit which establishes a reference pressure that can be used to enable shifting of the spool valve to different operational positions.

In various embodiments, the reference pressure is established at a pressure level higher than an input pressure level. In well applications, the input pressure level may be an input well annulus pressure. The input well annulus pressure may be the normal or ambient wellbore annulus pressure at the depth of the actuation control system without additional pressure applied in the annulus. In some applications, however, the input well annulus pressure could be a predetermined elevated pressure above the normal wellbore annulus pressure at the subject depth. In embodiments described herein, the reference pressure is at an elevated pressure level increment above the input well annulus pressure, e.g. a 1000 psi increment or another predetermined pressure increment above the input well annulus pressure.

The actuation control system may be used in a variety of well and non-well related applications for actuating several types of devices. In well applications, for example, the actuation control system may be used in a well string to actuate a component or components between a plurality of operational positions. In a specific example, embodiments of the actuation control system may be employed for controlling a downhole dual valve having, for example, a circulating valve and a test valve.

According to an embodiment, the actuation control system entraps a reference pressure via relief valves and this reference pressure is used in shifting a spool valve between a plurality of operational positions, e.g. between three operational positions. In a downhole, dual valve application, shifting the spool valve between the plurality of operational positions corresponds with shifting the circulating valve and the testing valve between predetermined open and closed valve positions. The actuation control system, however, is able to shift the spool valve (and the controlled component or components) between operational positions without utilizing downhole electronics or control lines routed down along the wellbore. In operation, the actuation control system responds to a pressure input, e.g. a pressure change in the wellbore annulus, and provides a fully mechanical actuation without concern for temperature limitations or other limitations associated with downhole electronics, downhole batteries, and/or control lines.

Referring generally to FIG. 1, an embodiment of a well system 20 is illustrated as comprising a well string 22 deployed downhole into a wellbore 24 drilled into or through a formation 25. A wellbore annulus 26 is formed between the well string 22 and a surrounding wellbore wall 28 which may be a cased or open wellbore wall 28. Generally, the wellbore annulus 26 contains a fluid 30, e.g. a well fluid or other fluid, which may be used for transmitting pressure inputs along well string 22. In the embodiment illustrated, an actuation control system 32 is deployed in the well string 22, although the actuation control system 32 may be utilized in a variety of other well and non-well related applications.

The actuation control system 32 is a fully mechanical system in the sense that 32 may be used to actuate components based on pressure inputs, e.g. pressure inputs delivered along wellbore annulus 26, without additional control lines or electronic components located downhole. In the embodiment illustrated, the actuation control system 32 is used to selectively actuate at least one downhole component 34. In a specific example, the actuation control system 32 is part of or works in cooperation with a dual valve system 36 having, for example, a circulating valve 38 and a testing valve 40. The dual valve system 36 may be used in a variety of well applications, including downhole reservoir testing.

As described in greater detail below, the actuation control system 32 may be shifted between different operational positions based on pressure input delivered along wellbore annulus 26 via fluid 30. The shifting of actuation control system 32 between the different operational positions causes corresponding shifting of the circulating valve 38 and the testing valve 40 between different operational positions.

Figure 2:
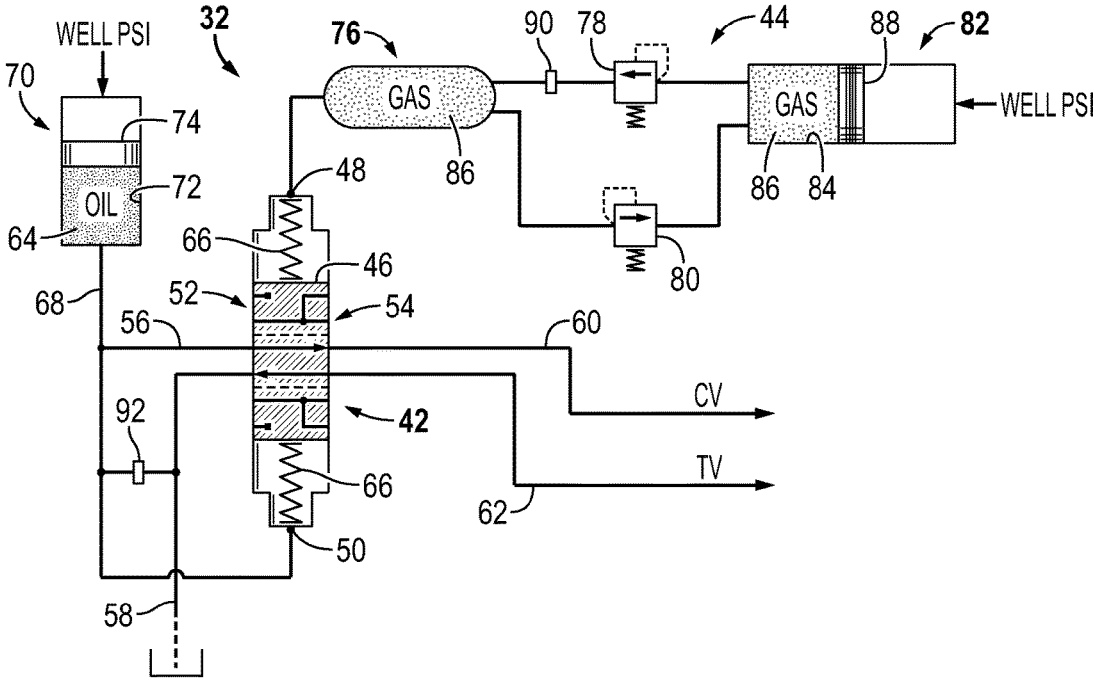
FIG. 2 is a schematic illustration of an example of an actuation control system, according to an embodiment of the disclosure.

Referring generally to FIG. 2, an embodiment of the actuation control system 32 is illustrated. In this example, actuation control system 32 comprises a spool valve 42 coupled with a reference pilot control circuit 44. The spool valve 42 comprises a spool 46 which is shiftable to different operational positions based on pressure inputs applied at a first port 48 and a second port 50 located on opposite sides of the spool 46. The different operational positions relate to different operational fluid flows through the spool valve 42 between a first side 52 and a second side 54 of the spool valve.

In the embodiment illustrated, the spool valve 42 is coupled with a well annulus pressure line 56 and a drain line 58 at first side 52. The spool valve 42 also is coupled with a first actuation line 60 and a second actuation line 62 at second side 54. The first and second actuation lines 60, 62 direct flow of an actuating fluid 64 to, for example, the component or components 34 so as to actuate the components 34 to desired operational positions. Depending on the application, the spool 46 of spool valve 42 may be biased to a default position by, for example, spring members 66 or other suitable biasing mechanisms.

As illustrated, both the well annulus pressure line 56 and the second port 50 are exposed to the wellbore annulus 26 and pressure in the wellbore annulus via a pressure line 68 and an accumulator 70. The accumulator 70 may comprise a chamber 72 filled with actuating fluid 64 and fluidly coupled with pressure line 68. The accumulator 70 also may comprise a piston 74 positioned between the actuating fluid in chamber 72 on one side and wellbore annulus pressure on the opposite side. Thus, piston 74 may be used to effectively apply well annulus pressure to well annulus pressure line 56 and second port 50.

The reference pilot control circuit 44 is coupled with the first port 48 and is constructed to establish a desired reference pressure at the first port 48. The reference pressure acting at first port 48 and the well annulus pressure applied at second port 50 control the shifting of spool 46 to different operational positions in spool valve 42. In various applications, the reference pressure is established at a predetermined level so that changing the wellbore annulus pressure to different predetermined levels effectively shifts spool valve 42 to the desired operational position. As discussed above, the reference pressure may be established at a pressure level higher than in input well annulus pressure. The input well annulus pressure may be the normal or ambient wellbore annulus pressure at the depth at which actuation control system 32 is located without additional pressure applied in the annulus, e.g. the input well annulus pressure may be the normal hydrostatic pressure at a given depth. In some applications, however, the input well annulus pressure can be a predetermined elevated pressure above the normal wellbore annulus pressure at the subject depth.

Referring again to FIG. 2, the illustrated reference pilot control circuit 44 comprises a gas reservoir 76 fluidly coupled with first port 48 of spool valve 42. The pilot control circuit 44 also comprises a pair of opposed relief valves 78, 80 coupled with gas reservoir 76 and oriented in opposed directions with respect to gas reservoir 76. The opposed relief valves 78, 80 are biased to a closed position until pressure is applied at a predetermined, elevated pressure level above the input well annulus pressure. An example of the elevated pressure level is 1000 psi above the input well annulus pressure. However, a variety of other pressure increments, e.g. 1500 psi, 2000 psi, 2500 psi, or other suitable pressure increments, can be used by selecting or constructing relief valves 78, 80 to actuate upon application of the desired elevated pressure increment above the input well annulus pressure. Once the opposed relief valves 78, 80 are actuated, the gas reservoir 76 is charged to a pressure at the corresponding elevated pressure increment, e.g. 1000 psi, above the input well annulus pressure.

In the example illustrated, the opposed relief valves 78, 80 are in communication with pressure in wellbore annulus 26 through a reference accumulator 82. By way of example, reference accumulator 82 may comprise a chamber 84 containing a gas 86, e.g. nitrogen or other suitable gas. The gas 86 is delivered through, for example, relief valve 78 into gas reservoir 76. The reference accumulator 82 further comprises a piston 88 disposed in chamber 84 between gas 86 and wellbore annulus 26. The reference pilot control circuit 44 effectively forms a reference pressure loop containing gas reservoir 76, relief valves 78, 80, and reference accumulator 82.

Depending on the application, the actuation control system 32 may comprise other and/or additional components. In some applications, for example, the actuation control system 32 may incorporate rupture discs 90, 92 or other suitable pressure relief devices. In the example illustrated, actuation control system 32 comprises rupture disc 90 disposed between relief valves 78 and gas reservoir 76. Additionally, the actuation control system 32 comprises rupture disc 92 disposed between pressure line 68 and drain line 58. The rupture discs 90, 92 or other suitable pressure relief devices provide for relief of pressure if pressure levels exceed a predetermined threshold with respect to, for example, reference pilot control circuit 44 or spool valve 42.

In a specific operational example, the spool valve 42 is coupled with reference pilot control circuit 44; and opposed relief valves 78, 80 are employed to retain a reference pressure in gas reservoir 76 for application at first port 48. The reference pressure is at a predetermined elevated level above the input well annulus pressure, e.g. approximately 1000 psi above the input well annulus pressure. In some embodiments, such as the embodiment illustrated in FIG. 2, the components 34 may be powered and the actuation control system 32 may be controlled via pressure inputs provided along wellbore annulus 26. For example, the well annulus pressure can be used to provide the pressure which causes actuating fluid 64 to flow through the spool valve 42 for powering operation of the components 34, e.g. valves 38, 40.

Depending on the application, there may be multiple different setpoints of applied pressure above the input well annulus pressure to effect transition of spool valve 42 between different operational positions. In one embodiment, for example, there may be three different set points of applied pressure, e.g. set points approximately equal to the input well annulus pressure, approximately 1000 psi above the input well annulus pressure, and approximately 2000 psi above the input well annulus pressure. However, other numbers of set points and other elevated pressure levels may be selected.

Figure 3:
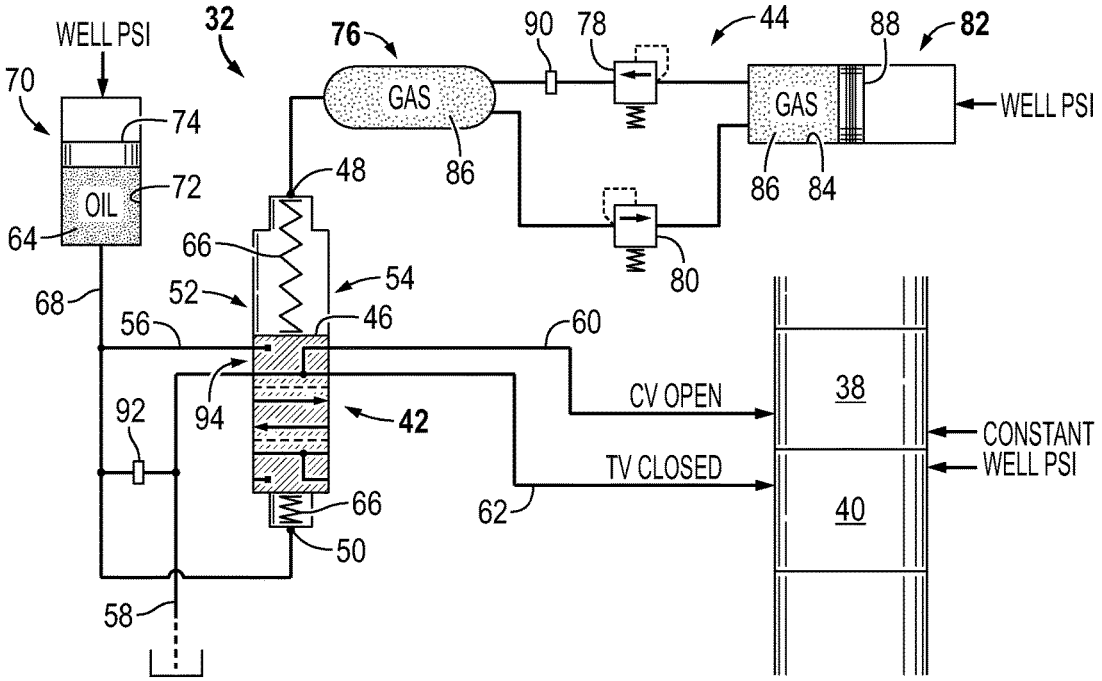
FIG. 3 is a schematic illustration of an actuation control system similar to that illustrated in FIG. 2 and shown in a given operational position, according to an embodiment of the disclosure.

To facilitate explanation, a specific operational example is described with reference to FIGS. 3-5. In this example, the actuation control system 32 is coupled into well string 22 and used to control dual valve system 36 having circulating valve 38 and testing valve 40. In a first operational configuration, no elevated pressure input is applied along wellbore annulus 26. Thus, the pressure in wellbore annulus 26 remains at the input well annulus pressure which is below the reference pressure established by reference pilot control circuit 44, e.g. 1000 psi below the reference pressure. Accordingly, the reference pressure applied at first port 48 is higher than the pressure at second port 50 and spool 46 is shifted (downwardly in FIG. 3) to a position which utilizes a first flow regime 94 of spool valve 42. In this operational position, first actuation line 60 and second actuation line 62 are shifted into communication with drain line 58. The circulating valve 38 and the testing valve 40 are constructed and biased such that shifting of the spool valve 42 to this operational position causes the circulating valve 38 to open and the testing valve 40 to close.

Figure 4:
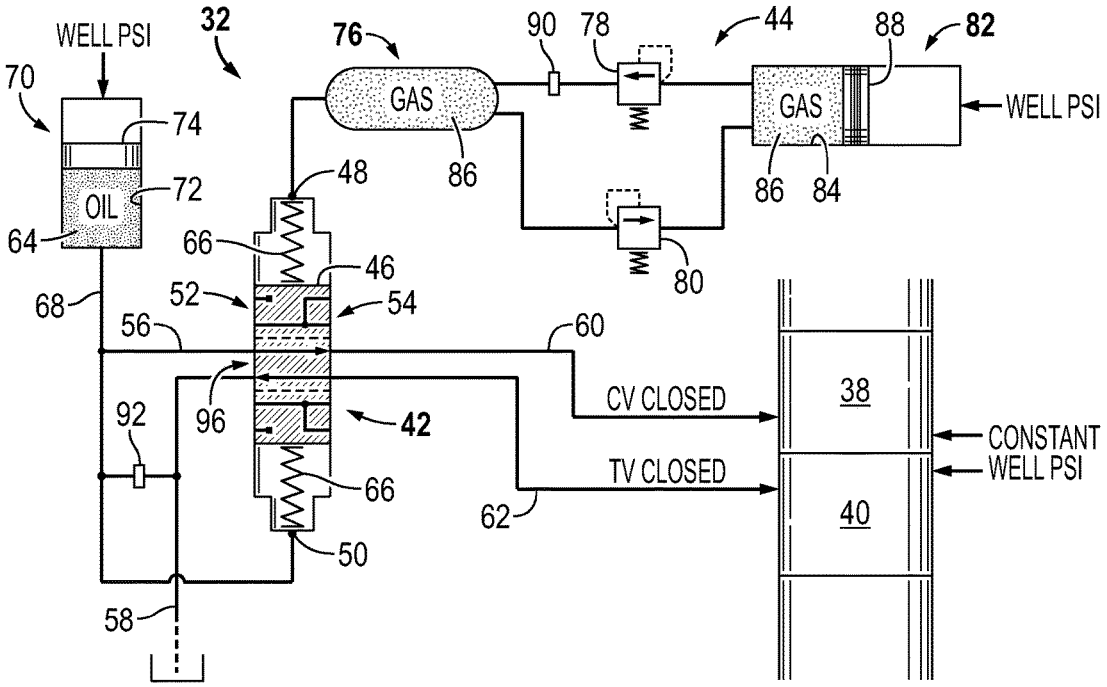
FIG. 4 is a schematic illustration of the actuation control system illustrated in FIG. 3 in another operational position, according to an embodiment of the disclosure.

Referring generally to FIG. 4, an incremental elevated pressure, e.g. an additional 1000 psi, is applied in wellbore annulus 26 to shift spool 46 and spool valve 42 to a second operational position. Effectively, the pressure in wellbore annulus 26 is incrementally raised to a predetermined elevated pressure level such that the pressure acting at second port 50 is approximately equal to the reference pressure applied at first port 48. This allows the bias of, for example, spring members 66 to shift spool 46 to the second operational position illustrated in FIG. 4, thus utilizing a second flow regime 96 of spool valve 42. In this operational position, first actuation line 60 and second actuation line 62 are shifted into communication with well annulus pressure line 56 and drain line 58, respectively. The circulating valve 38 and the testing valve 40 are constructed and biased such that shifting of the spool valve 42 to this second operational position causes the circulating valve 38 to close and the testing valve 40 to remain closed.

Figure 5:
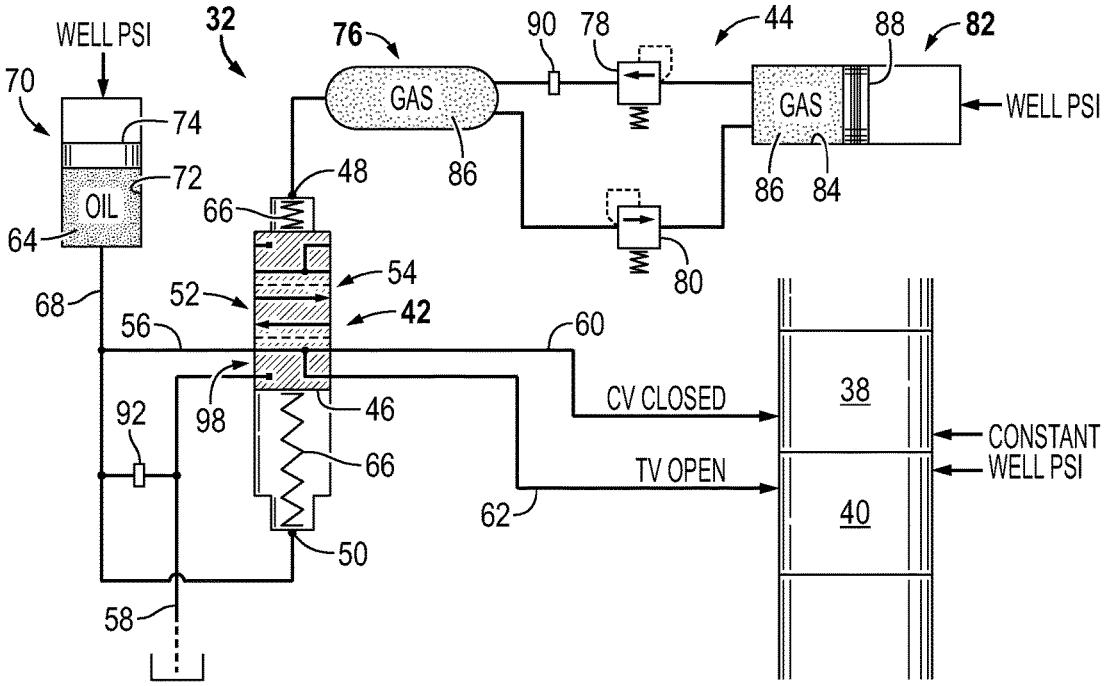
FIG. 5 is a schematic illustration of the actuation control system illustrated in FIG. 3 in another operational position, according to an embodiment of the disclosure.

Referring generally to FIG. 5, an additional incremental elevated pressure, e.g. a pressure of approximately 2000 psi above the input well annulus pressure, is applied in wellbore annulus 26 to shift spool 46 and spool valve 42 to a third operational position. Effectively, the pressure in wellbore annulus 26 is incrementally raised to a predetermined elevated pressure level such that the pressure acting at second port 50 is higher than the reference pressure applied at first port 48, e.g. approximately 1000 psi higher than the reference pressure. Because the pressure at second port 50 is higher than the reference pressure applied at first port 48, spool 46 is shifted (upwardly in FIG. 5) to a position which utilizes a third flow regime 98 of spool valve 42. In this operational position, first actuation line 60 and second actuation line 62 are shifted into communication with well annulus pressure line 56. The circulating valve 38 and the testing valve 40 are constructed and biased such that shifting of the spool valve 42 to this operational position causes the circulating valve 38 to remain closed and the testing valve 40 to open.

It should be noted, however, that the operational positions of spool valve 42 and the corresponding operational positions of valves 38, 40 are provided as examples and that other shifting patterns may be used in a given application. For example, the spool valve 42 may be shifted between two operational positions or to a number of operational positions greater than three. Additionally, an individual valve or other individual component 34 may be shifted between a plurality of operational positions. Similarly, a plurality of valves or other components may be shifted between various cooperating operational positions.

Depending on the application, the actuation control system 32 may be used with several types of well equipment or non-well related equipment for actuating valves and/or other types of devices. In well applications, the actuation control system 32 is useful in controlling operation of a dual valve system via a fully mechanical system which can be operated without separate electronics or control lines routed from the surface. However, the actuation control system 32 may be utilized in many other types of well applications and with other types of well strings to control actuation of a variety of valves and other components between operational positions.

Similarly, the actuation control system 32 itself may comprise a variety of other and/or additional components and features. For example, various configurations of spools, spool valves, and accumulators may be employed for controlling the flow of actuating fluid 64. Additionally, the reference pilot control circuit 44 may comprise a variety of components in various loops and configurations. Different types of relief valves, pressure relief devices, gas reservoirs, biasing mechanisms, gases, and/or other components may be incorporated into the control circuit. Similarly, the components may be constructed to enable setting of a variety of selected reference pressures at a desired pressure increment or increments.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for actuating devices in a well, comprising:

an actuation control system having:

a spool valve coupled to a well pressure line and a drain line on a first side of the spool valve and to a first actuation line and a second actuation line on a second side of the spool valve, the spool valve being shiftable to a plurality of operational positions based on pressures applied at a first port and a second port of the spool valve; and a reference pilot control circuit coupled with the first port to establish a reference pressure at the first port while the second port is exposed to wellbore annulus pressure of a wellbore annulus, the reference pilot control circuit comprising a gas reservoir and a pair of opposed relief valves which enable the reference pressure to be established in the gas reservoir at a level higher than an input wellbore annulus pressure, wherein the input wellbore annulus pressure is either a predetermined value or normal wellbore annulus pressure.

2. The system as recited in claim 1, wherein the spool valve may be selectively shifted to different operational positions by raising pressure in the wellbore annulus to predetermined elevated pressure levels above the input well annulus pressure.

3. The system as recited in claim 1, wherein the first actuation line is coupled with a first valve.

4. The system as recited in claim 3, wherein the second actuation line is coupled with a second valve.

5. The system as recited in claim 4, wherein the first valve is a circulating valve and the second valve is a testing valve.

6. The system as recited in claim 1, wherein the actuation control system is part of a downhole dual valve deployed in a well string.

7. The system as recited in claim 1, wherein the spool valve is shiftable to three operational positions.

8. The system as recited in claim 1, wherein the well pressure line is coupled with an accumulator having a piston exposed to wellbore annulus pressure.

9. The system as recited in claim 1, wherein the reference pilot control circuit further comprises a reference accumulator exposed to wellbore annulus pressure in a the wellbore annulus to enable setting of the reference pressure in the gas reservoir via application of a desired pressure increase along the wellbore annulus.

10. A system, comprising:

an actuator control system having:

a spool valve shiftable between three different operational positions based on relative pressures applied at a first port and a second port of the spool valve; and a reference pilot control circuit which may be selectively set at a reference pressure which is applied to the first port while the second port is exposed to an external pressure, the external pressure being changed relative to the reference pressure to cause shifting of the spool valve, wherein the reference pilot control circuit comprises a gas reservoir which may have internal pressure of the gas reservoir increased to a desired level above an input well annulus pressure via application of an elevated well annulus pressure, the gas reservoir being operatively coupled with the first port, and wherein the reference pilot control circuit further comprises a pair of opposed relief valves coupled to the gas reservoir.

11. The system as recited in claim 10, wherein the actuator control system is part of a well string.

12. The system as recited in claim 11, wherein the reference pilot control circuit further comprises a reference accumulator coupled with the pair of opposed relief valves on an opposite side of the pair of opposed relief valves relative to the gas reservoir.

13. The system as recited in claim 10, wherein the actuator control system is coupled with two valves and controls actuation of the two valves, and wherein the external pressure is changed by increasing or decreasing pressure in a wellbore annulus.

14. The system as recited in claim 13, wherein the two valves are part of a downhole dual valve system having a circulating valve and a testing valve.

15. A method, comprising establishing a reference pressure at a first port of a spool valve via a reference pilot control circuit which is pressurized to a level different than an input well annulus pressure;

exposing a second port of the spool valve to pressure in a well annulus; and setting the spool valve to a desired position of a plurality of positions by selectively changing the pressure in the well annulus;

wherein establishing the reference pressure comprises using a gas reservoir coupled with a pair of opposed relief valves in the reference pilot control circuit to enable setting of the reference pressure at a predetermined higher level relative to the input well annulus pressure.

16. The method as recited in claim 15, wherein setting comprises setting the spool valve at one of three different operational positions.

17. The method as recited in claim 15, wherein selectively changing the pressure comprises applying pressure in the well annulus either at the input well annulus pressure or at one of a plurality of incremental elevated pressures above the input well annulus pressure.

* * * * *